US005865232A

United States Patent [19]

Miller et al.

[11] Patent Number: 5,865,232

[45] Date of Patent: Feb. 2, 1999

[54] METHOD AND APPARATUS FOR CUTTING VENEER SHEETS FROM A TAPERED FLITCH

[75] Inventors: Thomas A. Miller, Indianapolis; Darrel C. Pinkston, Muncie, both of Ind.

[73] Assignee: Miller Veeners, Inc., Indianapolis, Ind.

[21] Appl. No.: 813,669

[22] Filed: Mar. 7, 1997

Related U.S. Application Data

[60] Provisional application No. 60/013,035 Mar. 8, 1996.

[51] Int. Cl.[6] ..... B27C 1/00; B27M 1/02

[52] U.S. Cl. ..... 144/363; 144/178; 144/177; 144/214; 269/50; 269/54.5; 269/265

[58] Field of Search ..... 279/2.02, 2.03, 279/2.04, 2.09; 269/54.1, 54.3, 54.2, 265, 268; 144/177, 178, 209.1, 214, 363, 365, 369, 356

[56] References Cited

U.S. PATENT DOCUMENTS

| | | |
|---|---|---|
| 793,306 | 6/1905 | Koss . |
| 2,576,520 | 11/1951 | Koss . |
| 2,676,627 | 4/1954 | McFall . |
| 3,441,069 | 4/1969 | Koss . |
| 3,654,973 | 4/1972 | Koss . |
| 3,680,612 | 8/1972 | Hale . |
| 3,808,925 | 5/1974 | Hards . |
| 3,905,408 | 9/1975 | Hale . |
| 4,068,693 | 1/1978 | Cremona . |
| 4,069,850 | 1/1978 | Cremona . |
| 4,392,519 | 7/1983 | Calvert . |
| 4,503,896 | 3/1985 | Brand . |
| 4,587,616 | 5/1986 | Weil . |
| 4,601,317 | 7/1986 | Brand . |
| 4,683,926 | 8/1987 | Weil . |
| 5,101,874 | 4/1992 | Weil . |
| 5,143,129 | 9/1992 | Toivio . |
| 5,150,746 | 9/1992 | Weil . |
| 5,333,658 | 8/1994 | Albion et al. . |
| 5,381,841 | 1/1995 | Weil . |
| 5,385,184 | 1/1995 | Mellor . |
| 5,562,137 | 10/1996 | Brand . |
| 5,694,995 | 12/1997 | Brand ..... 144/365 |

FOREIGN PATENT DOCUMENTS

0627285A2 12/1994 European Pat. Off. .

*Primary Examiner*—W. Donald Bray
*Attorney, Agent, or Firm*—Clifford W. Browning; Woodard, Emhardt, Naughton, Moriarty & McNett

[57] ABSTRACT

A novel method and apparatus for cutting veneer sheets from a tapered flitch (one-half of a veneer log which has been sawn in half longitudinally) that places the veneer producing face of a tapered flitch in a stable, parallel relationship with the veneer slicing knife, thereby allowing full utilization of the natural taper of a veneer log.

20 Claims, 12 Drawing Sheets

METHOD AND APPARATUS FOR CUTTING VENEER SHEETS FROM A TAPERED FLITCH

This application claims the benefit of prior co-pending provisional application Ser. No. 60/013,035, filed Mar. 8, 1996.

The present invention relates to cutting veneer sheets from veneer logs, generally, and more particularly to a novel method and apparatus for cutting veneer sheets from a tapered flitch (one-half of a veneer log which has been sawn in half longitudinally) that places the veneer producing face of a tapered flitch in a stable, parallel relationship with the veneer slicing knife, thereby allowing full utilization of the natural taper of a veneer log.

BACKGROUND OF THE INVENTION

Preparing logs for veneering begins in the sawmill. This milling process, known as "flitching", takes place on either a circular saw or a bandsaw. Traditionally, the veneer logs have been sawn at the mill to remove the log's natural taper so that the logs are left somewhat squared at the butt end, leaving substantially no taper remaining in the log from top to bottom, as opposed to from side to side, and from the small end to the butt end—substantially all of the taper from the top to the bottom having been removed from the butt end of the log. See FIGS. 1 & 2. This squaring up process results in the removal of valuable veneer wood from the butt end of the veneer log. The squared up veneer log is then sawn in half lengthwise, and two flitches are thereby produced. The two flitches may or may not be of the same thickness, but each squared up flitch will hold substantially the same longitudinal thickness from top to bottom from its small end to its butt end. See FIG. 2.

Fifty or more flitches are placed in a vat of water at a veneer mill to be heated in preparation for slicing. They are then extracted, a few at a time, and mounted one at a time on the rotary-staylog of a conventional rotary-staylog veneer slicing machine by any number of conventional dogging (attachment) systems. The typical rotary-staylog has a cast iron body that extends the length of the cutting surface of a veneer-slicing knife. The rotary-staylog body is fixed between the lathe centers of the head stock and the tail stock of the machine and rotates between them, as would a woodturning in a conventional lathe. Presently, the preferred dogging systems in use to attach a squared up flitch to a conventional rotary-staylog veneer slicing machine require that at least two parallel grooves be cut into the flat underside of the flitch (FIG. 2), each of a sufficient size to receive a plurality of pairs of hydraulically driven clamping dogs that are spaced along the entire length of and extend about 1 in. above the rotary-staylog's mounting surface. The pairs of clamping dogs engage the flitch within the grooves when the flitch is laid flush upon the rotary staylog's mounting surface and pinch the flitch between the grooves to secure the flitch to the rotary-staylog.

The presence of grooves cut into the flat underside of the flitch results in a weakening of the edges of the flitch as the flitch's size is reduced by the slicing of veneer sheets from the flitch as it rotates on the rotary-staylog. Eventually, a springing action occurs under the hydraulic force of the clamping dogs and the veneer slicing knife as a result of the thinning of the wood between the grooves and the face of the flitch from which the veneer is being removed. This produces "shim sheets" or sheets of veneer with edge thicknesses that taper away to nothing, as opposed to sheets that maintain a consistent thickness across the entire width of the sheets. The inclusion of the "shim sheets" with the otherwise saleable veneer will result in customer dissatisfaction because these sheets will result in the rejection of veneer faces that include these thinner than allowable or "shim sheets." It is presently considered to be good practice to discard these "shim sheets" as they come off the rotary-staylog, which results in less product, lower yields, poor resource use, and less profit for the veneer mill.

It is common practice for veneer mills to plane the underside of the flitch prior to or during the grooving procedure to achieve a perfectly flat and hence more stable surface to attach, or dog, the squared up flitch to conventional rotary-staylog—it being believed that a more stable cut will be the result. This, however, requires the loss of even more material from the squared up flitch and results in less of the flitch being reduced into usable veneer. The shimming problem still occurs as before, for the wood still springs as the grooves approach the face of the flitch from which the veneer is being removed. In addition, the most modern dogging systems in use (that still require grooving) leave an unsliceable flitch core of approximately 1 in. thickness at the core's thickest point.

SUMMARY OF THE INVENTION

The novel method for cutting veneer sheets from a tapered flitch of the present invention comprises attaching a naturally tapered flitch to a staylog such that the veneer producing face of the naturally tapered flitch is placed in a stable, parallel relationship with the veneer slicing knife, thereby allowing full utilization of the natural taper of a veneer log from nearly the first cut of the veneer slicing knife, which results in superior veneer cuts, more consistent thickness of the resulting veneer sheets, no shimming out on the veneer sheets, and a much higher yield due to more of the flitch's outer surface and inner core being cut into veneer sheets. The method of the present invention generates an unsliceable core of approximately ½ in. thickness at its thickest point. The result is that ½ in. more per flitch may be cut into veneer sheets than by the conventional methods of the prior art.

Also according to the present invention, a novel apparatus is provided for retaining a tapered flitch on the staylog of a veneer slicing machine with the outer surface and veneer producing zone of the tapered flitch substantially parallel to the veneer slicing knife. The novel apparatus for retaining a tapered flitch on the staylog of a veneer slicing machine of the present invention comprises a novel staylog having double row of 3 in. collet dogs arranged in a staggered manner along the length of the staylog, each collet dog including an external collet having an internal pin that when activated by a hydraulic cylinder expands the external collet. A tapered flitch is processed prior to mounting on the novel staylog of the present invention to include a plurality of holes for receiving the collet dogs. The holes in the tapered flitch are cut deeper in the thicker butt end of the tapered flitch and more shallow in the thinner end of the tapered flitch, with all the holes in the tapered flitch terminating at substantially the same distance from the outer veneer producing surface of the tapered flitch, thereby cooperating to define a plane upon which the tapered flitch rests that places the outer surface and veneer producing zone of the tapered flitch substantially parallel to the veneer slicing knife.

The present invention is not limited to use on rotary staylogs of rotary-staylog veneer slicing machines, such as the one illustrated and described below, and may be incorporated into a reciprocating veneer slicer.

One embodiment of the present invention is a method for cutting veneer sheets from a tapered flitch, comprising the steps of providing a staylog for a veneer slicing machine having a veneer slicing knife; attaching a flitch having a tapered veneer producing face to the staylog with the tapered veneer producing face of the flitch affixed in a stable, parallel relationship with the veneer slicing knife; and cutting veneer sheets with the veneer slicing knife from the tapered veneer producing face of the flitch.

Another embodiment of the present invention is a method for retaining a flitch on a staylog for slicing veneer from the flitch, the staylog having a plurality of expandable collet dogs, comprising the steps of providing a flitch having a plurality of holes for receiving a plurality of collet dogs; positioning the plurality of collet dogs within the plurality of holes in the flitch; and expanding the collet dogs to retain the flitch on the staylog.

Another embodiment of the present invention is a method for retaining a flitch on a staylog for slicing veneer from the flitch, the staylog having a plurality of expandable collet dogs, comprising the steps of providing a flitch having a plurality of holes for receiving a plurality of collet dogs; positioning the plurality of collet dogs within the plurality of holes in the flitch; and expanding the collet dogs to retain the flitch on the staylog.

Another embodiment of the present invention is an apparatus for retaining a flitch with a tapered veneer producing face on the mounting surface of a staylog for movement past a veneer slicing knife, comprising collet dogs extending from the mounting surface of the staylog for engaging the flitch, and means for expanding the collet dogs when engaged with the flitch to hold the flitch on the staylog with the tapered veneer producing face of the flitch in a parallel relationship with the veneer slicing knife so as to minimize the amount of waste veneer taken from the tapered veneer producing face of the flitch.

Another embodiment of the present invention is an apparatus for retaining a flitch on a staylog, the flitch including a plurality of holes formed in the flat underside surface thereof, comprising: a staylog for carrying the flitch; a plurality of collet dogs attached to the staylog and positioned to be received by the plurality of holes formed in the flat underside of the flitch for engaging the flitch, and means for expanding the collet dogs when engaged with the flitch to hold the flitch on the staylog.

Another embodiment of the present invention is an apparatus for retaining a flitch for slicing, comprising: a staylog having a mounting surface with a plurality of predetermined positions, and a plurality of collet dogs located at the predetermined positions for engaging the flitch to retain the flitch on the staylog, wherein the distance between the mounting surface and the flitch at a predetermined position is proportional to the thickness of the flitch at the predetermined position.

Another embodiment of the present invention is a dog for retaining a flitch for cutting, comprising: a collet collar for engaging the flitch, having a base flange that is moveably engageable with a staylog; and means for expanding the collet collar to engage the flitch to hold the flitch on the staylog.

It is a principal object of the present invention to provide a novel method and apparatus for cutting veneer sheets from a tapered flitch that includes attaching a naturally tapered flitch to a staylog such that the veneer producing face of the naturally tapered flitch is placed in a stable, parallel relationship with the veneer slicing knife, thereby allowing full utilization of the natural taper of a veneer log from nearly the first cut of the veneer slicing knife, which results in superior veneer cuts, more consistent thicknesses of the resulting veneer sheets, no shimming out on the veneer sheets, and a much higher yield due to more of the flitch's outer surface and inner core being cut into veneer sheets.

Related objects and advantages of the method and apparatus for cutting veneer sheets from a tapered flitch will be evident from the following description.

BRIEF DESCRIPTION OF THE DRAWING FIGURES

FIG. 1 is a prior art drawing figure.

FIG. 2 is a prior art drawing figure.

DETAILED DESCRIPTION OF THE PREFERRED EMBODIMENTS

For the purposes of promoting an understanding of the principles of the invention, reference will now be made to the preferred embodiments of the invention and specific language will be used to describe the same. It will nevertheless be understood that no limitation of the scope of the invention is thereby intended, as such alterations and further modifications in the described invention, and such further application of the principles of the of the invention as described therein, are contemplated as would normally occur to one skilled in the art to which the invention relates.

Figure 1:
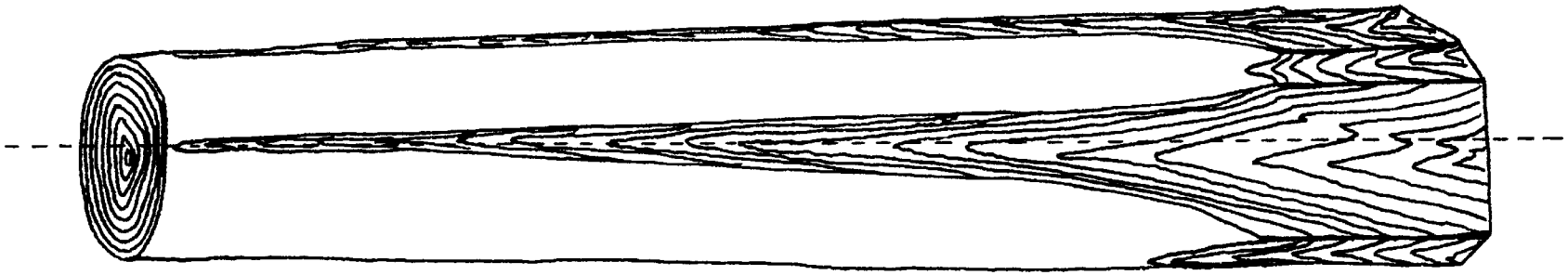
Fig.1 (Prior Art)
FIG. 1 is a perspective view of a squared up 16 in. veneer log prior to being sawn in two along the dotted line to create two squared up flitches of the prior art.
Figure 2:
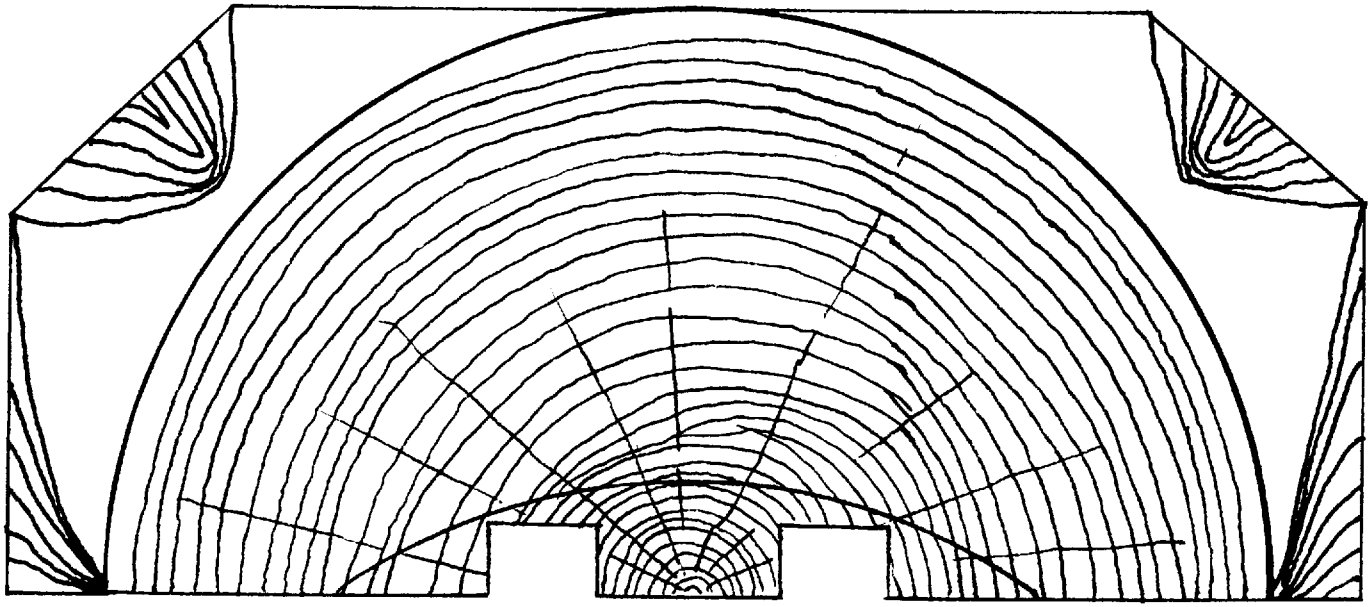
Fig.2 (Prior Art)
FIG. 2 is an end view of the top end of one of the squared up flitches sawn from the squared up 16 in. veneer log of FIG. 1 that has been grooved for attachment to a conventional rotary-staylog of the prior art.
Figure 3:
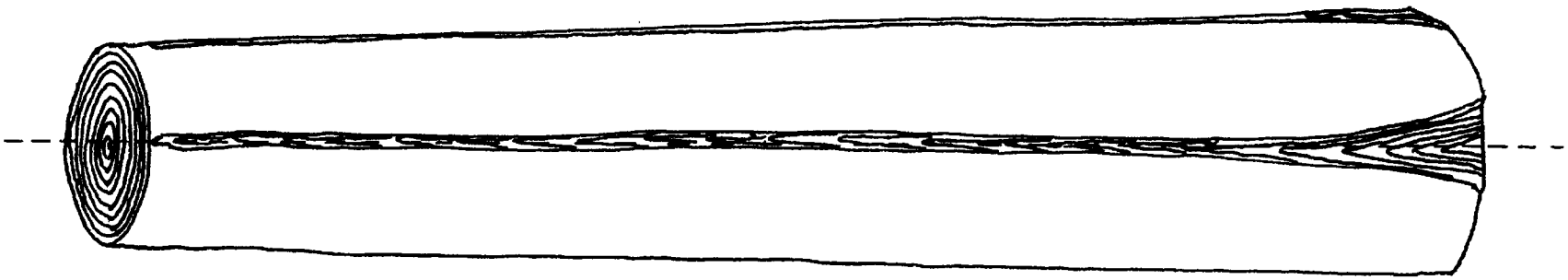
FIG. 3 is a perspective view of a tapered veneer log that has been sawn by keeping just to the outside of the log, thereby retaining the natural taper in the log, that will be sawn in half and the resulting flitches used in the method and apparatus of the present invention.

The novel method and apparatus for cutting veneer sheets from a tapered flitch of the present invention requires different flitching techniques than those used in the prior art. Rather than removing substantially all of the top to bottom taper from a veneer log in the squaring up process performed in the sawmill, the method and apparatus of the present invention requires the sawyer to just barely engage the veneer log on all four sides and along its entire length—that is, the sawyer keeps to the outside of the log By so doing, once the log has been faced on all four sides, the veneer log will still retain substantially all of its natural taper. See FIG. 3. When the tapered veneer log is then sawn in half lengthwise to create two flitches, neither flitch holds the same thickness from end to end—each flitch retains its natural taper. Generally speaking, each tapered flitch will have at least 1 in. of natural taper from one end of the flitch to the other, with some tapered flitches having as much as 3 in. of natural taper. The amount of natural taper in the flitches will vary from species to species, with the greatest taper occurring in the sun-loving, more open grown species, such as walnut and white oak, and the least taper occurring in the deep woods species, such as red oak and cherry.

The most preferred apparatus to date for putting into practice the novel method of the present invention for attaching a naturally tapered flitch to a rotary-staylog such that the veneer producing face of the naturally tapered flitch is placed in a stable, parallel relationship with the veneer slicing knife is the apparatus hereinafter referred to as the collet-dogging rotary staylog 10, which is illustrated in FIGS. 4–15 with dovetail ends 11 mounted thereon that correspond to the end spindles of the lathe to which the staylog 10 will be mounted. The collet-dogging rotary staylog 10 differs significantly from the rotary staylogs of the prior art in the manner in which it secures a tapered flitch to the stay-log. The collet-dogging rotary staylog 10 of the present invention requires reworking of the conventional rotary staylogs as follows.

Referring now the drawings, the dogs of the novel collet-dogging rotary staylog 10 of the present invention for attaching a tapered flitch 16 (shown in dashed lines) to staylog 10 are hydraulically actuated collet dogs 12 that extend approximately 3 in. above the mounting surface 14 of the rotary staylog 10, as compared to the dogging clamps of the prior art that project a mere 1 in. or less above the mounting surfaces of the staylogs of the prior art. Referring now to FIGS. 4–9, in the preferred embodiment to date of the collet-dogging rotary staylog 10 of the present invention, illustrated with a tapered flitch 16 shown in dashed lines mounted thereon, two parallel rows of circular collet dogs 12 are arranged in a staggered relationship along substantially the full length of the mounting surface 14 of rotary-staylog 10. The circular collet dogs 12 are sized to be inserted into corresponding holes 18 that have been bored into the flat underside of the tapered flitch 16 while it is being processed for mounting on the staylog 10. The depths of the holes 18 are selectively sized such that the top end of each of the collet dogs 12 makes contact with the bottom of the corresponding hole 18 in the tapered flitch when the tapered flitch 16 is lowered onto the rotary-staylog 10.

To further explain this important aspect of the present invention, the holes 18 to be bored into the flat underside of the tapered flitch 16 before it is mounted on the staylog 10 may be excavated by means of a series of drills that have been arranged in such a way as to bore the holes 18 in one upward plunge cut in to the flat underside of the tapered flitch 16. The positioning of the resulting holes along the underside of the tapered flitch 16 correspond to the positioning of the collet dogs 12 on the mounting surface 14 of the rotary-staylog 10. A typical boring machine consists of a steel frame which supports a surface table) on which to place the tapered flitch 16 flat underside down. The small end 20 of the tapered flitch rests on a gate that adjusts either up or down until the top curved surface of the tapered flitch is level from the small end 20 to the large end 22. Once the leveling has been achieved, the height that the flitch's small end rests above the table is noted, and the depth of the drills' upward plunge is adjusted accordingly. All of the drill assemblies are arranged on a steel frame mounted under the flitch supporting table so that, when activated by mechanical means, the steel frame slowly raises and the required pattern of holes is bored into the flat underside of the tapered flitch at precisely the correct depth. The depth of the holes 18 in the flat underside of the tapered flitch varies from the shallow 1/16 in. on the small end 20 of the tapered flitch 16 to as much as 3 in. on the large or butt end 22 of the tapered flitch 16—these measurements being determined by the extent of the natural taper in the tapered flitch 16. The depth of the holes in the small end can be adjusted to provide for any desired minimum depth.

Figure 4:
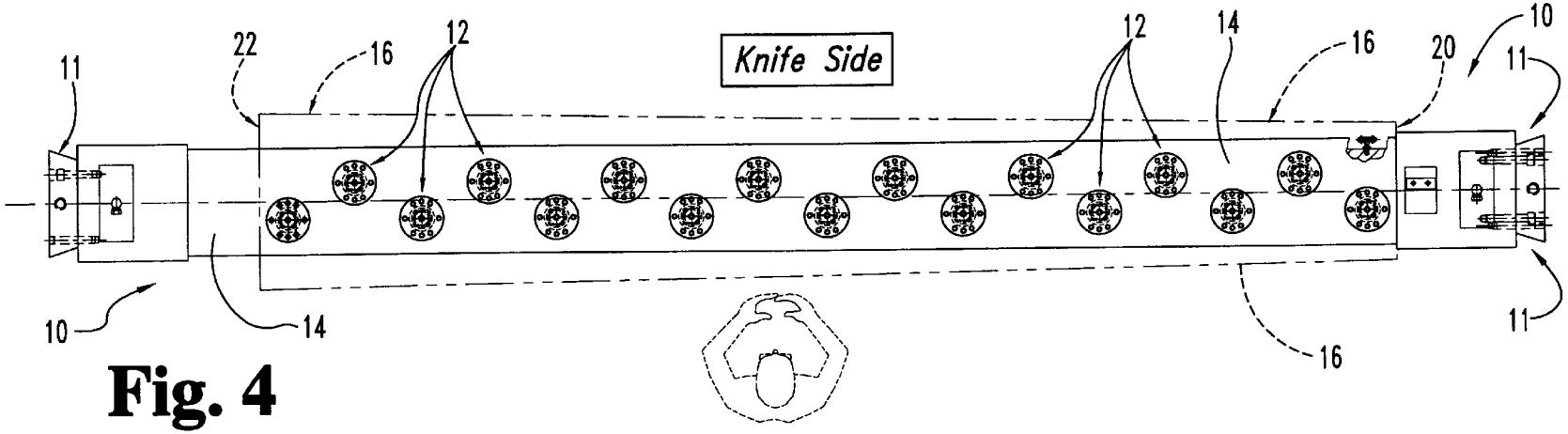
FIG. 4 is top plan view of a collet dogging rotary stay log of the present invention with a tapered flitch, shown in dashed lines, mounted thereon.
Figure 5:
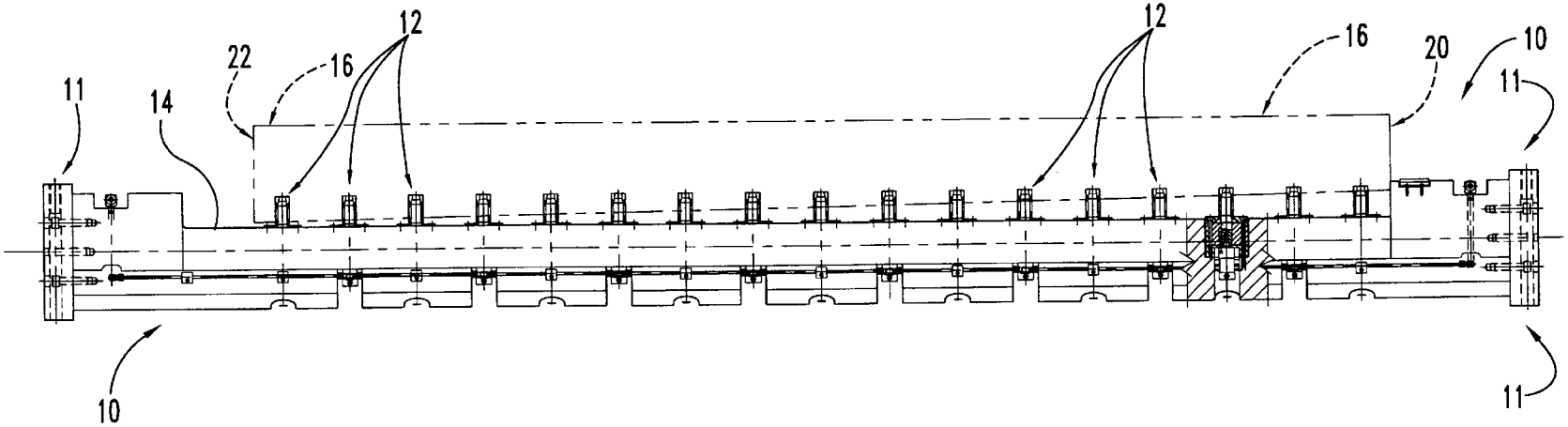
FIG. 5 is a front elevation and partially segmented view of the collet dogging rotary staylog of FIG. 4.

Once the tapered flitch 16 has been prepared for mounting on the rotary-staylog 10 in the manner described above, the tapered flitch 16 is hoisted from the boring machine and lowered onto the collet dogs 12 on the mounting surface 14 of the rotary-staylog 10 until the pockets 18 have bottomed out on the tops of the collet dogs 12, as illustrated in FIGS. 4 and 5. As illustrated in FIG. 5. The tapered flitch does not lie flush against the mounting surface 14 of rotary staylog 10, as would a squared up flitch mounted on a rotary staylog of the prior art. However, the top curved surface of the tapered flitch 16 is level from the small end 20 to the large end 22, and thus the veneer producing face of the naturally tapered flitch 16 is in a substantially parallel relationship with the mounting surface 14 and thus the veneer slicing knife. The tapered flitch 16 is held stable in this position when hydraulic cylinders 24 are activated and the collet dogs 12, which are attached to the hydraulic cylinders 24, expand within the holes 18 of the tapered flitch 16 to thereby secure the tapered flitch 16 in place on the rotary-staylog 10 (FIGS. 4 & 5).

Figure 10:
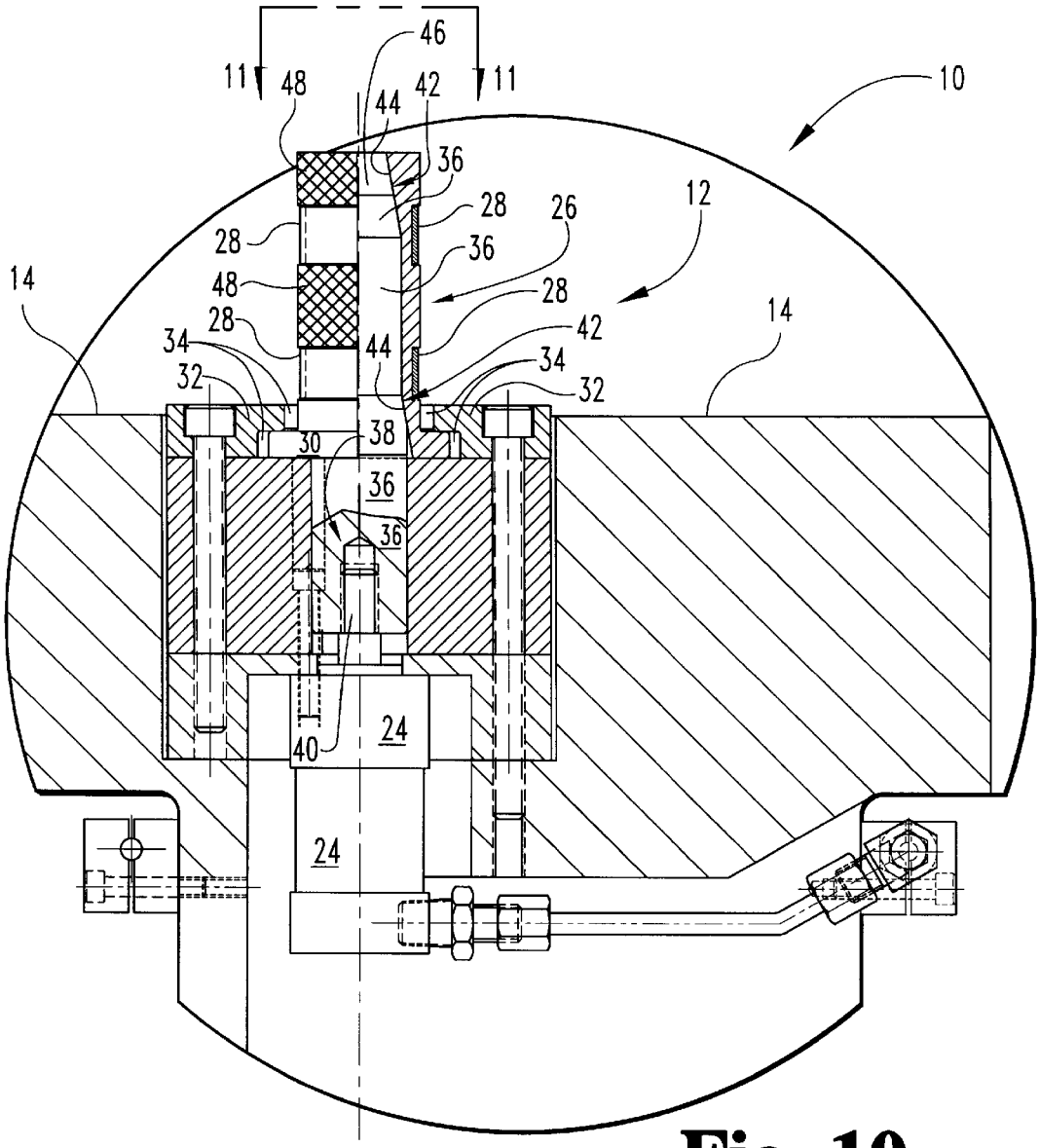
FIG. 10 is an enlarged partial sectional view taken along line 10—10 in FIG. 8.
Figure 11:
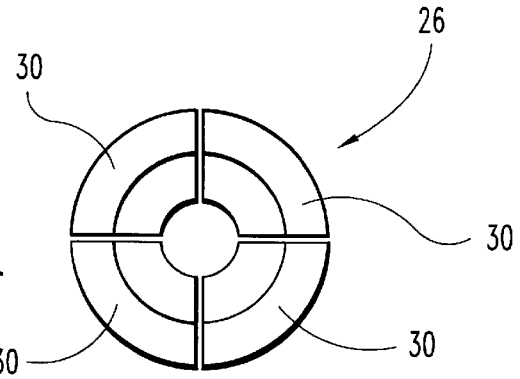
FIG. 11 is a top plan view taken along line 11—11 in FIG. 10.
Figure 13:
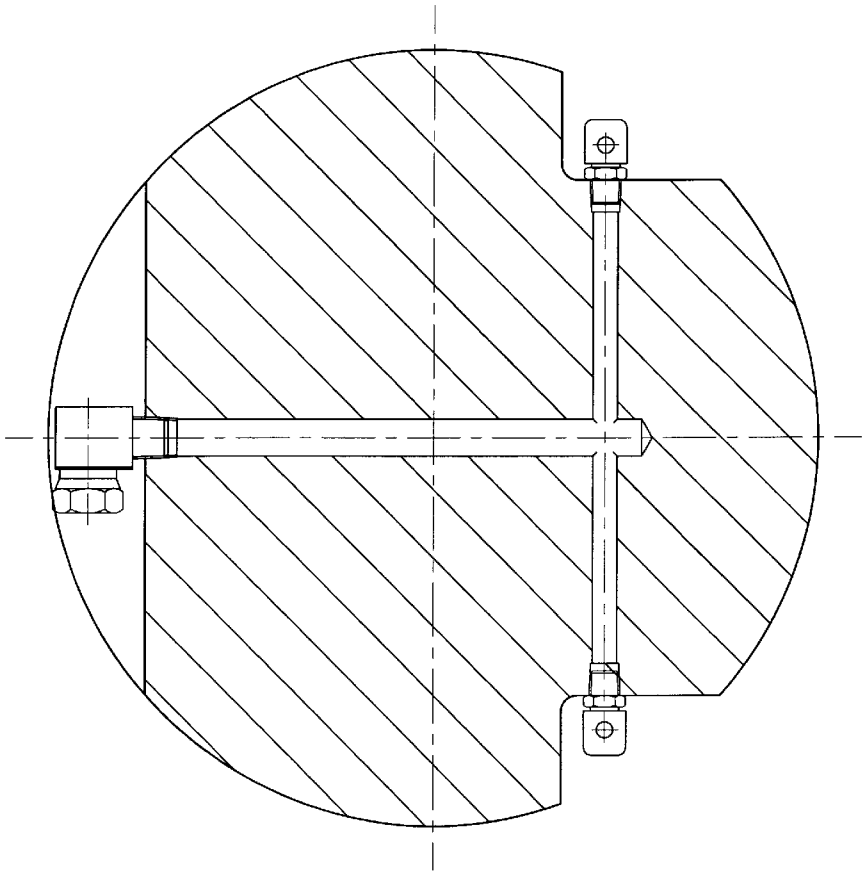
FIG. 13 is an enlarged sectional view taken along line 13—13 in FIG. 7
Figure 12:
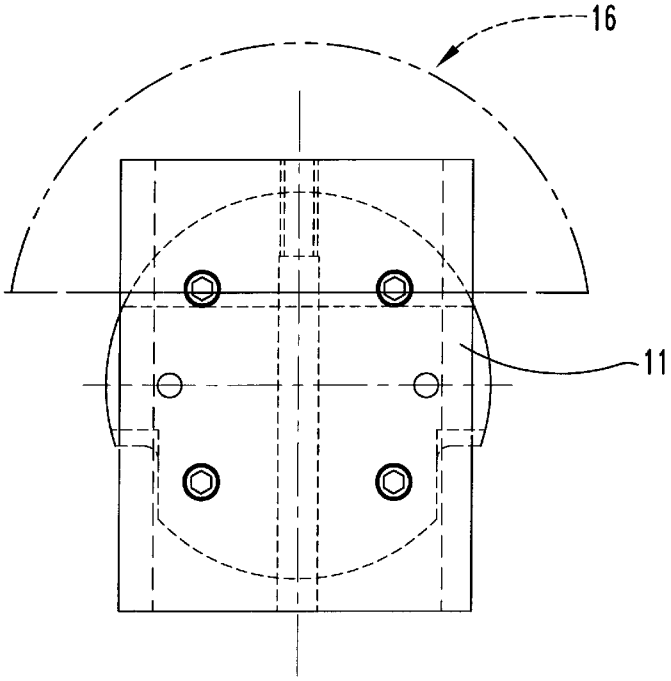
FIG. 12 is an elevation view of the left end of the collet dogging rotary staylog of FIG. 4.

Referring now to FIGS. 10 & 11, in the preferred embodiment to date of the collet dogging rotary staylog 10 of the present invention, each collet dog 12 includes a circular collet collar 26 that has been sectioned into 4 independent quadrants (FIG. 11). The 4 independent quadrants of collet collar 26 are held in circular disposition by steel hose clamps 26, which are sufficiently elastic to permit the 4 quadrants of collet collar 26 to expand outwardly, but not beyond the elastic limit of the steel from which the clamps 26 are constructed, so that the clamps 26 will return the collet collar 26 to its original disposition, as illustrated in FIG. 10. Each quadrant of the collet collar 26 has a base flange 30 by which the 4 quadrants of each collet collar 26 are retained on the mounting surface 14 of the rotary staylog 10 in cooperation with a circular steel cap 32. Spaces 34 are provided between each circular steel cap 32 and each collet collar 26 and its base flanges 30 to allow for the expansion outwardly of the 4 quadrants of collet collar 26.

Still referring to FIG. 10, within each collet collar 26 is a steel plunger 36, which is attached to hydraulic cylinder 24 by means of a threaded connection 38 to the piston 40 of the hydraulic cylinder 24. Hydraulic cylinder 24 is hydraulically powered and controlled by conventional means. The conventional hydraulic connections to each of the hydraulic cylinders 24 for each of collet dogs 12 of the preferred staylog 10 of the present invention are well illustrated in the Figs.

Figure 16:
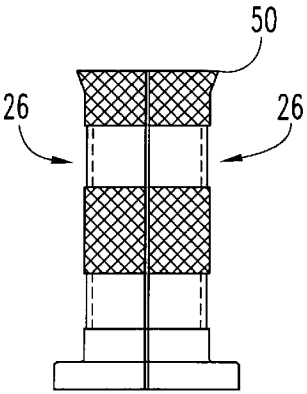
FIG. 16 is an elevation view of an alternative embodiment of the collet collar 26 FIG. 10.

When piston 40 of hydraulic cylinder 24 moves upwardly, plunger 40 moves upwardly into the open space 46 near the top of collet collar 26, and the upper and lower sloped shoulders 42 of plunger 40 cooperate with correspondingly sloped shoulders 44 on the inside surfaces of the 4 quadrants of each collet collar 26 to apply an equal outward force from top to the bottom of each of the 4 quadrants of each collet collar 26. As a result, the 4 quadrants of each collet collar expand uniformly outwardly into contact with the holes 18 of tapered flitch 16. On the most preferred embodiment of the collet collars 26 to date, shallow knurling 48 has been provided to the outer surfaces of the 4 quadrants of each collet collar to provide additional grip between the collet collars and the pockets 18 of tapered flitch 16. In an alternative embodiment, referring now to FIG. 16, a slight flair 50 may be provided to the topmost portion of each of the 4 quadrants of each collet collar 26 to provide additional gripping power between the collet collars 26 and the pockets 18 of tapered flitch 16.

The tapered flitch 16, as it is positioned on the rotary-staylog 10 relative to the veneer cutting knife, has its entire curved outer face from which veneer will be cut substantially parallel to the veneer cutting knife's edge. When the knife advances toward the spinning tapered flitch 16 and first engages the flitch 16, the knife will be cutting the entire length of the tapered flitch 16 due to the fact that the entire length of curved outer surface of the tapered flitch 16 is aligned with the veneer cutting knife. The veneer cutting knife cuts along the entire length of the tapered flitch 16 from the very first cut and from the very first veneer sheet produced thereby. This is in contrast to the prior art methods of attaching squared up flitches flush with the staylog's mounting surface, where due to saw run-out or intentional sawing in preparing the veneer logs only the butt end of the squared up flitch engages the veneer cutting knife for many of the first cuts of the knife and many of the first sheets produced thereby. This results in short, tapered sheets of veneer with low value and high production costs. These tapered sheet bundles can include 50 sheets or more.

Figure 6:
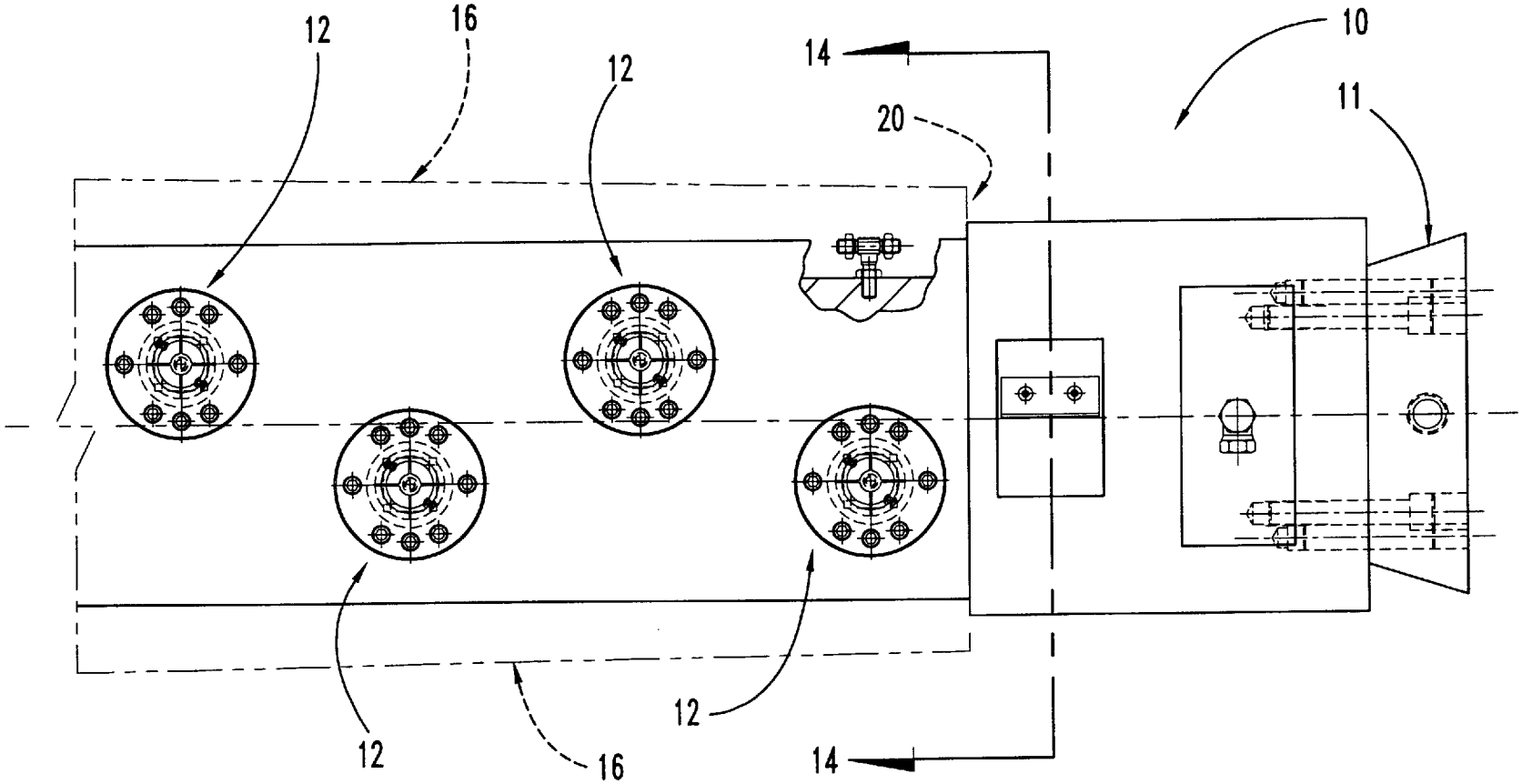
FIG. 6 is an enlarged top plan view of the right end of the collet dogging rotary staylog of FIG. 4.
Figure 7:
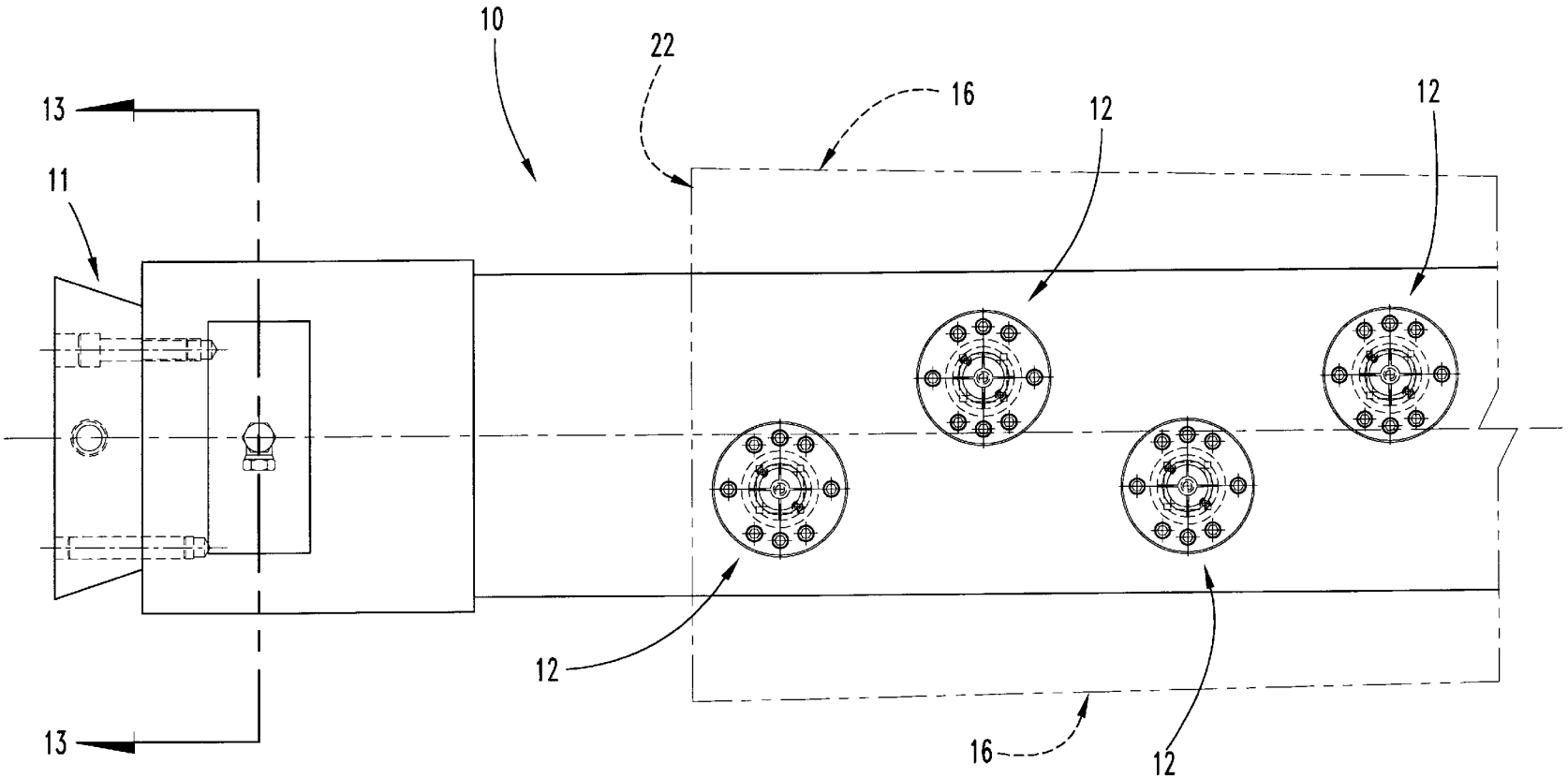
FIG. 7 is an enlarged top plan view of the left end of the collet dogging rotary staylog of FIG. 4.
Figure 8:
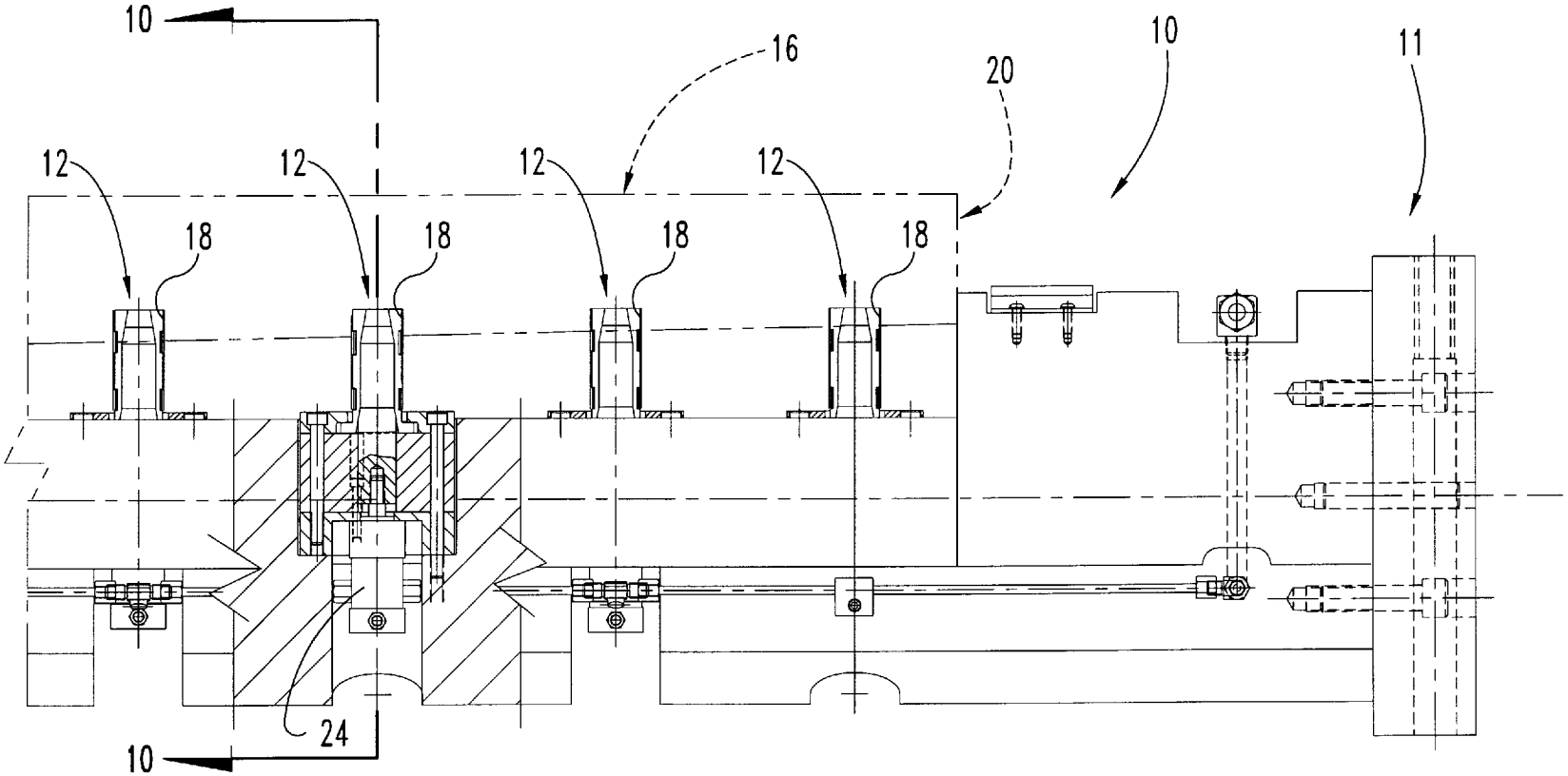
FIG. 8 is an enlarged front elevation and partially segmented view of the right end of the collet dogging rotary staylog of FIG. 4.
Figure 9:
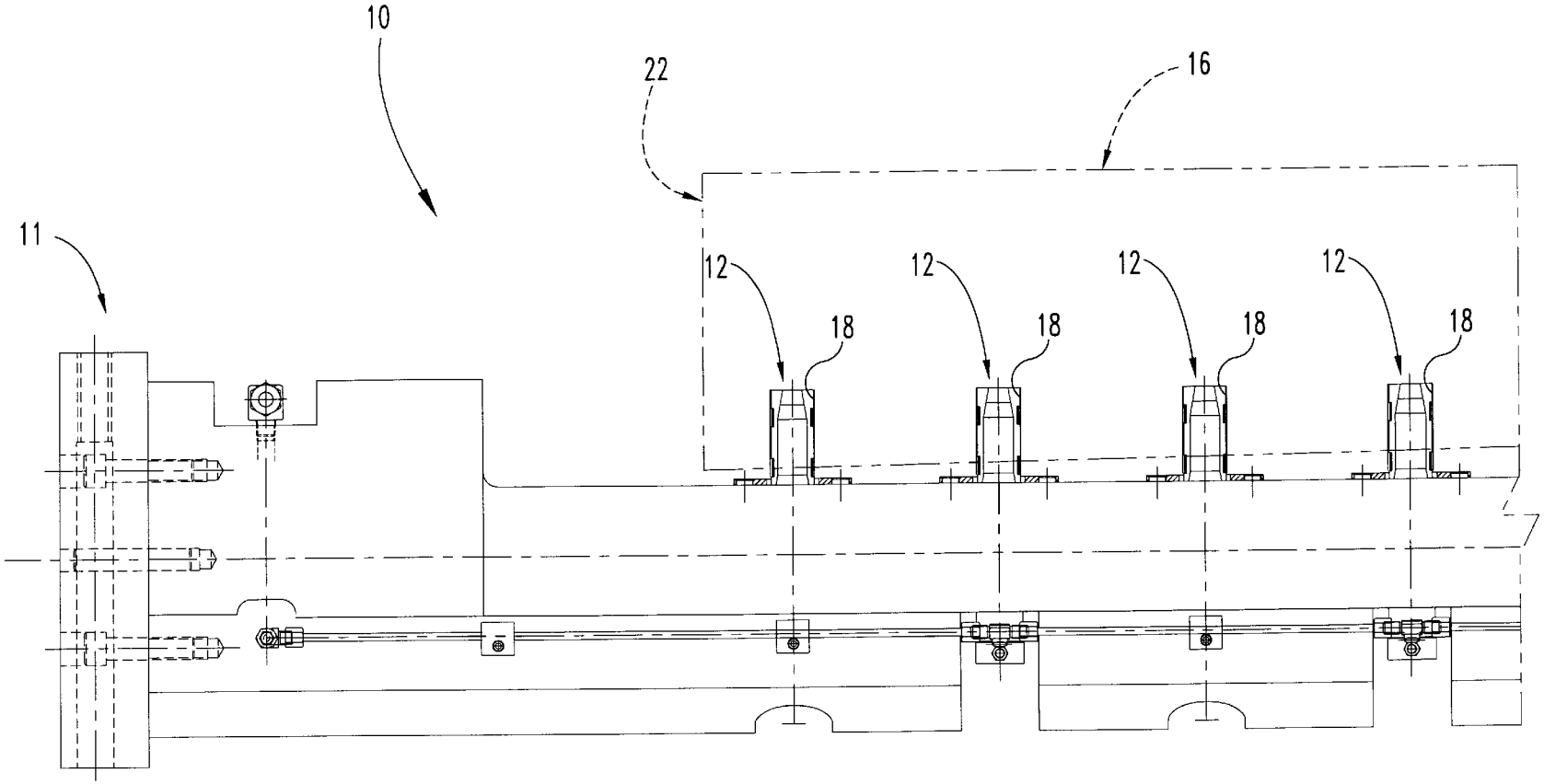
FIG. 9 is an enlarged front elevation and partially segmented view of the left end of the collet dogging rotary staylog of FIG. 4.
Figure 15:
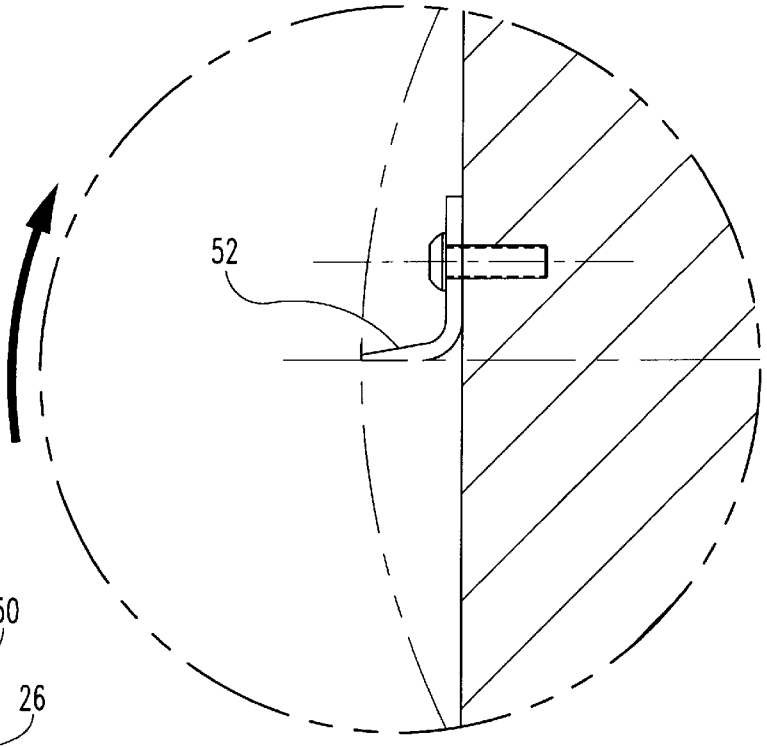
FIG. 15 is an enlarged view of the area defined by line 15 in FIG. 14.
Figure 14:
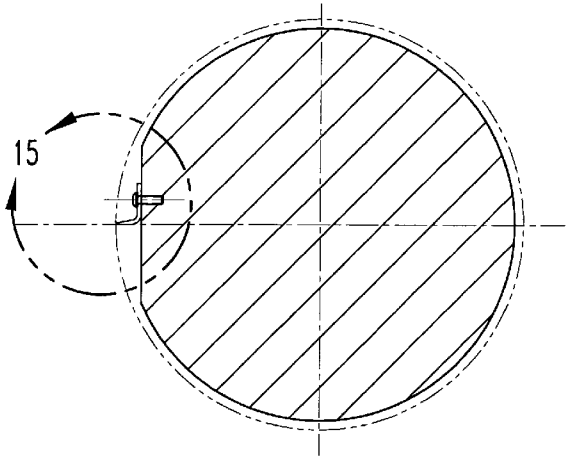
FIG. 14 is an enlarged sectional view taken along line 14—14 in FIG. 6.
Figure 17:
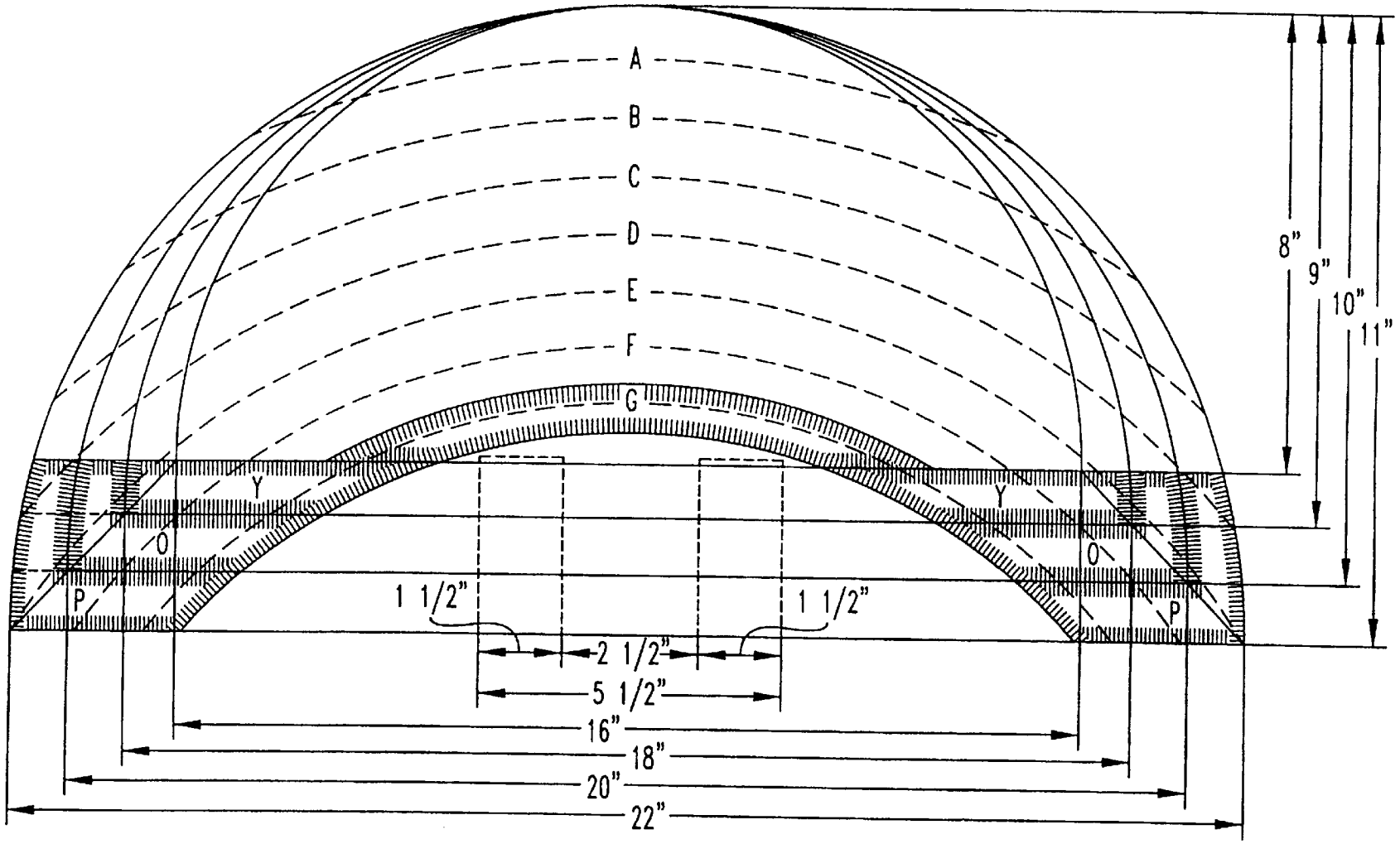
FIG. 17 is a veneer yield diagram illustrating veneer yield increases.

The first several dozen sheets coming off a tapered flitch utilizing the method and apparatus of the present invention are of more value than would have been obtained utilizing the methods and apparatus of the prior art, because they are of full flitch length and are therefore more useful to more customers for their lengths do not restrict their uses. Referring now to FIG. 17, these sheets would be represented by those sliced from a tapered flitch from the top down to slice A in FIG. 17. The sheets sliced from slice A down to approximately half way between slice C and slice D would be very close in size and quality to those cut by the traditional methods of the prior art. However, from midway between slice C and slice D and on throughout the tapered flitch, the width of the butt end of the sheets would be increased as is shown by the dotted lines representing slices D, E, F, and G from where they extend below the line which represents the point 8 in. below the top of the tapered flitch. The entire width gained below the 8 in. line is due to the retention of the veneer log's natural taper. The gain in sheet width depends on the extent of the taper. The lines below the 8 in. line represent the butt end of a tapered flitch with a 1 in. taper, a 2 in. taper, and a 3 in. taper. The solid arced line between dotted lines F and G represents the last sheet that could be recovered from a squared up flitch that is being sliced on a machine of the prior art. The area between that solid arced line and the solid arced line below the dotted line represents the additional veneer recoverable due to the ability to reduce the required depth of engagement of the collet dogs in relation to the small end of the tapered flitch. The shallower depth of engagement is due to the strength that is obtained by having the depth of the pockets cut in the tapered flitch grow progressively deeper as they extend toward the butt of the veneer log, according to the method of the present invention. Referring now to FIGS. 6, 14 and 15, a novel cut alarm indicator mounted to the rotary staylog 10 is illustrated that serves to warn the lathe operator that the collet dogs 12 will strike the veneer knife's edge within a few more revolutions of the rotary staylog 10. Flexible tab 52, which will make an audible noise when struck by the veneer knife, may be adjusted up or down to suit the operators wishes.

The overall quality of the veneer is enhanced in several ways by utilizing the novel method and apparatus of the present invention. The first sheets off the knife are full flitch length, not short and tapered. The heartwood tends to come in along the full length of the sheets at the same time rather than start at the butt end and slowly work its way up. This enables the user to get valuable full length sheets much sooner than the present methods of veneer cutting.

The first half of the veneer coming off the tapered flitch is generally free of heart defects, but trees do not grow without limbs and sooner or later the knots appear. At about the same time that the knots appear, the sheets' butt end begins to widen due to the taper being left in the flitch. This additional width not only increases the yield for the veneer producer, but it also allows the end user or export veneer producer the option to clip out the knots by holding to the edge of the sheet. The method of attachment, i.e. collet dogging method versus the grooved method, allows the tapered flitch to remain steady through the cut and thereby avoid shim sheets. The stability of cut is also greatly enhanced because the tapered flitch is resting fully on the ends of the collet dogs.

The volume of veneer produced from each log is increased as follows, referring again to FIG. 17. The "b" section represents the yield increase due to the downsizing of the residual core from at least 1 in. to as little as ½ in. The "y"'s, "o"'s, and "p"'s represent the yield increase due to the inclusion of the taper: "y"'s equal 1 in. taper; "o"'s and "y"'s equal 2 in. taper; "p"'s, "o"'s, and "y"'s equal 3 in. taper.

While the invention has been illustrated and described in detail in the drawings and the above description with reference to preferred embodiments to date, the same is to be considered as illustrative and not restrictive in character, it being understood that only the preferred embodiments have been shown and described and that all changes and modifications that come within the scope and spirit of the invention are desired to be protected. For example, although the preferred embodiment of the invention have been illustrated and described utilizing a rotary-staylog veneer slicing machine, it may also be used in a transversely moving veneer slicing machine.

We claim:

1. A method for cutting veneer sheets from a tapered flitch, comprising the steps of providing a staylog for a veneer slicing machine having a veneer slicing knife;

attaching a flitch having a tapered veneer producing face to the staylog with the tapered veneer producing face affixed in a stable, parallel relationship with the veneer slicing knife; and cutting veneer sheets with the veneer slicing knife from the tapered veneer producing face of the flitch.

2. A method for retaining a flitch on a staylog for slicing veneer from the flitch, the staylog having a plurality of expandable collet dogs, comprising the steps of providing a flitch having a plurality of holes for receiving a plurality of collet dogs;

positioning the plurality of collet dogs within the plurality of holes in the flitch; and expanding the collet dogs to retain the flitch on the staylog.

3. The method of claim 2 wherein the expanding step includes means for hydraulically expanding the collet dogs to retain the flitch on the staylog.

4. The method of claim 3 wherein the expanding step further includes knurling on the surfaces of the collet dogs that engage the flitch to retain the flitch on the staylog.

5. The method of claim 4 wherein the expanding step further includes a flair on the topmost surfaces of the collet dogs that also engages the flitch to retain the flitch on the staylog.

6. A method of retaining a flitch on a staylog for slicing veneer from the flitch, the staylog having a plurality of collet dogs, comprising the steps of providing a flitch having a plurality of holes for receiving the plurality of collet dogs, the holes having a depth profile and the collet dogs having flitch engaging portions configured to generally conform to the depth profile;

positioning the plurality of collet dogs in the plurality of holes; and engaging the flitch with the collet dogs to retain the flitch on the staylog with a veneer producing zone maintained in parallel relation to a veneer slicing knife.

7. The method of claim 6 wherein the engaging step includes means for hydraulically expanding the collet dogs to retain the flitch on the staylog.

8. The method of claim 7 wherein the engaging step further includes knurling on the surfaces of the collet dogs that engage the flitch to retain the flitch on the staylog.

9. The method of claim 8 wherein the engaging step further includes a flair on the topmost surfaces of the collet dogs that also engages the flitch to retain the flitch on the staylog.

10. An apparatus for retaining a flitch with a tapered veneer producing face on the mounting surface of a staylog for movement past a veneer slicing knife, comprising collet dogs extending from the mounting surface of the staylog for engaging the flitch, and means for expanding the collet dogs when engaged with the flitch to hold the flitch on the staylog with the tapered veneer producing face of the flitch in a parallel relationship with the veneer slicing knife so as to minimize the amount of waste veneer taken from the tapered veneer producing face of the flitch.

11. The apparatus of claim 10 wherein the means for expanding includes knurling on the surfaces of the collet dogs that engage the flitch to retain the flitch on the staylog.

12. The apparatus of claim 11 wherein the means for expanding further includes a flair on the topmost surfaces of the collet dogs that also engages the flitch to retain the flitch on the staylog.

13. The apparatus of claim 10 and further comprising means for sounding an alarm when the continued movement of the veneer producing face past a veneer slicing knife would result in the veneer slicing knife contacting the collet dogs.

14. An apparatus for retaining a flitch on a staylog, the flitch including a plurality of holes formed in the flat underside surface thereof, comprising:

a staylog for carrying the flitch;

a plurality of collet dogs attached to the staylog and positioned to be received by the plurality of holes formed in the flat underside of the flitch for engaging the flitch, and means for expanding the collet dogs when engaged with the flitch to hold the flitch on the staylog.

15. The apparatus of claim 14 wherein the means for expanding includes knurling on the surfaces of the collet dogs that engage the flitch to retain the flitch on the staylog.

16. The apparatus of claim 15 wherein the means for expanding further includes a flair on the topmost surfaces of the collet dogs that also engages the flitch to retain the flitch on the staylog.

17. An apparatus for retaining a flitch for slicing, comprising:

a staylog having a mounting surface with a plurality of predetermined positions, and a plurality of collet dogs located at the predetermined positions for engaging the flitch to retain the flitch on the staylog, wherein the distance between the mounting surface and the flitch at a predetermined position is proportional to the thickness of the flitch at the predetermined position.

18. The apparatus of claim 17 wherein the collet dogs further include knurling on the surfaces of the collet dogs that engage the flitch to retain the flitch on the staylog.

19. The apparatus of claim 18 wherein the collet dogs further include a flair on the topmost surfaces of the collet dogs that also engages the flitch to retain the flitch on the staylog.

20. A dog for retaining a flitch for cutting, comprising:

a collet collar for engaging the flitch, having a base flange that is moveably engageable with a staylog; and means for expanding the collet collar to engage the flitch to hold the flitch on a staylog.

* * * * *

Adverse Decision in Interference

Patent No. 5,865,232, Thomas A. Miller, Darrel C. Pinkston, METHOD AND APPARATUS FOR CUTTING VENEER SHEETS FROM A TAPERED FLITCH, Interference No. 105,215, final judgment adverse to the patentees rendered May 14, 2007, as to claim 1.

*(Official Gazette October 23, 2007)*